United States Patent [19]

Zahn

[11] Patent Number: 4,870,750

[45] Date of Patent: Oct. 3, 1989

[54] DEVICE FOR MACHINE-FASTENING ROOFING MATERIALS TO ROOFS

[76] Inventor: Harold Zahn, In der Etzwiese 17, 6906 Leimen/Heidelberg, Fed. Rep. of Germany

[21] Appl. No.: 161,980

[22] Filed: Feb. 29, 1988

[30] Foreign Application Priority Data

May 28, 1987 [DE] Fed. Rep. of Germany ... 8707666[U]

[51] Int. Cl.[4] ..... B25C 1/02

[52] U.S. Cl. ..... 29/809; 81/431; 227/15; 227/18; 227/110

[58] Field of Search ..... 52/747, 748, 749, 127.5; 29/525.1, 771, 809, 810; 227/147, 99, 15, 18, 110, 114; 81/431

[56] References Cited

U.S. PATENT DOCUMENTS 4,246,939 1/1981 Boegel ..... 81/431
4,436,235 3/1984 Hebert ..... 227/147 X
4,627,563 12/1986 Meyer ..... 227/147 X
4,657,167 4/1987 Mays ..... 227/114
4,706,864 11/1987 Jacobsen et al. ..... 227/147 X

*Primary Examiner*—Timothy V. Eley
*Attorney, Agent, or Firm*—Staas & Halsey

[57] ABSTRACT

A method and corresponding apparatus accurately and efficiently fasten roofing materials to a roof. A first stroke of a piston both separates a single roofing screw from a roofing screw magazine and delivers it to a premounting position and separates a metal bracket from a metal bracket magazine and delivers it to a metal bracket premounting position. The second or return stroke places the screw and the metal bracket into respective mounting positions. A power screwdriver screws the screw through the metal bracket and the roofing materials placed on the roof and into the ceiling structure. The apparatus is mounted on a mobile frame to allow easy movement of the apparatus from fastening position to fastening position on the roof.

17 Claims, 6 Drawing Sheets

FIG. 1
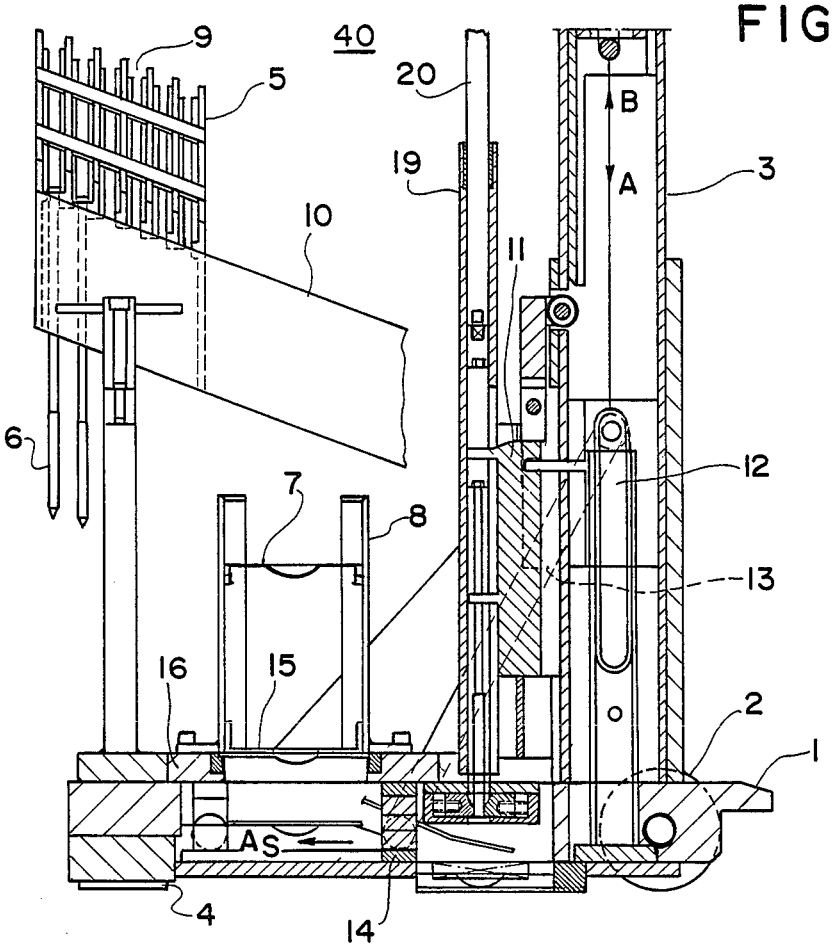
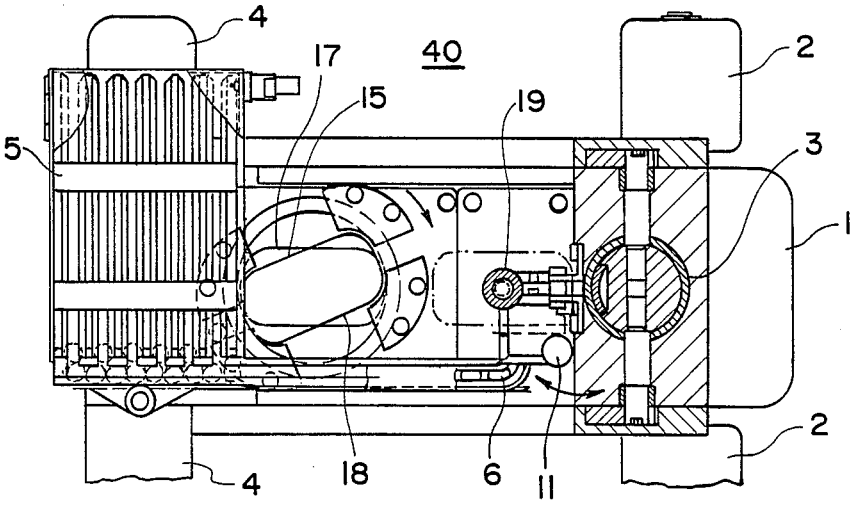
FIG. 2

DEVICE FOR MACHINE-FASTENING ROOFING MATERIALS TO ROOFScl BACKGROUND OF THE INVENTION

1. Field of the Invention

The invention relates to a method and a device for the machine-fastening of roof-sealing foils and associated insulating materials to roofs.

2. Description of the Related Art

All types of flat roofs are covered with roof-sealing foils and insulating materials, which are selected to meet the requirements of each particular roof. In general, most flat roofs have large areas, yet labor intensive manual roof-laying techniques have been standard in the industry. Labor intensive methods are costly, and roof-laying can involve high degrees of risk to the workers. Also, conventional labor intensive roof-laying techniques have proven to have quality problems, especially with respect to the quality of the seal. Most often this is due to the fact that the mounting elements used for mounting the roofing material are not correctly inserted into the existing ceiling structure.

SUMMARY OF THE INVENTION

Therefore, an object of the present invention is to provide an efficient labor-saving method for the machine-depositing and machine-fastening of roof-sealing foils and all types of associated insulating materials to roofs.

Another object of the invention is to provide an apparatus for carrying out this method.

Accordingly, the present invention provides a method for the machine fastening of roofing materials to a roof, comprising the steps of positioning the roofing materials for fastening onto the roof, mechanically separating a bracket and a roofing screw from respective magazines containing prestored brackets and roofing screws, aligning the separated bracket and the separated roofing screw into respective mounting positions, screwing the screw through the bracket and roofing materials into the roof to fasten the roofing materials to the roof by means of a power screwdriver positioned above the mounting position of the screw, and mechanically separating the second bracket and a second roofing screw to continue the machine fastening process.

Accordingly, the present invention also provides a fastening apparatus for the machine fastening of roofing materials to a roof comprising a mobile frame having a pair of wheels, a mounting bracket magazine mounted on the frame and a roofing screw magazine also mounted on the frame. A bracket separator is situated in the frame beneath the bracket magazine for separating single mounting brackets from the mounting brackets stored in the bracket magazine. A depressible pressure column having a movable piston mounted therein is located on the frame above the wheels. A movable slide is connected to the piston for sliding the single, separated bracket into a bracket mounting position. A locking lever roller is also operatively connected to the piston and the screw magazine, and paces a single, separated screw into a screw mounting position. Finally, a power screwdriver is provided on the frame above the screw mounting position for screwing the single, separated screw through the single, separated bracket and any roofing materials and into the ceiling structure beneath the roof, fastening the roofing materials to the roof.

The objects and advantages of the present invention will become readily apparent from the description of the preferred embodiments and claims, reference being had to the accompanying drawings, wherein like reference numerals represent like parts throughout.

BRIEF DESCRIPTION OF THE DRAWINGS

FIG. 1 is an elevational view partially in cross-section illustrating a fastening apparatus according to the present invention;

FIG. 2 is a top view partially in cross-section illustrating the fastening apparatus of FIG. 1;

DESCRIPTION OF THE PREFERRED EMBODIMENT

Figure 3:
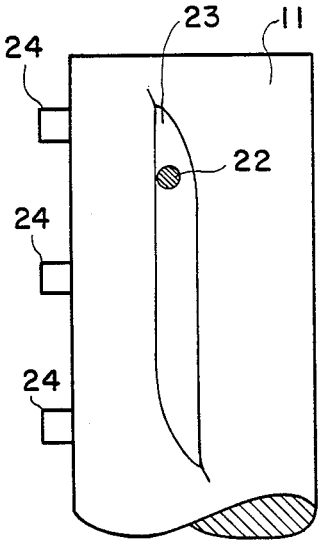
FIG. 3 is an elevational view of a locking lever roller portion of the apparatus of FIG. 1.

Referring now to FIGS. 1 and 2, a fastening apparatus or device 40 according to the present invention is illustrated in a cross-sectional elevational view and top view, respectively. A frame 1 of the fastening device 40 has a pair of wheels or rollers 2 to allow mobility. The wheels 2 are located beneath a compressible pressure column 3. The device 40 is moved on the wheels 2 by slightly tilting the device 40 toward the end having the pressure column 3, so that the device 40 is resting on the wheels 2, and using handles (not shown) mounted on the pressure column 3 to pull or push the device 40 to the desired location. Otherwise, the device 40 stands upright on a footrest 4, which is positioned under the end of the device 40 opposite from the pressure column 3. Where necessary, the bottom surface of the footrest 4 can be coated with a slip-free covering, such as rubber, in order to prevent unwanted movement of the device 40.

In addition to the pressure column 3, a screw magazine 5 and a mounting bracket magazine 8 are also mounted on the frame 1. Roof-construction screws 6 are loaded into and stored in the screw magazine 5. Likewise, mounting brackets 7 are loaded into and stored in the bracket magazine 8. The mounting brackets 7 can be made from a variety of materials, including metals and hard plastics. The mounting bracket magazine 8 consists of four corner members 8*a*, 8*b*, 8*c*, and 8*d* mounted with screws 46 onto a base plate 16 on the face of the frame 1. The corner members 8*a*, 8*b*, 8*c*, and 8*d* are mounted on the base plate 16 such that the bracket magazine 8 which they comprise stores the mounting brackets 7 obliquely to an and-to-end axis of the device 40.

The feeding of the screws 6 from the screw magazine 5 will now be described with reference to FIG. 5. Individual paths 9 (FIG. 1) for the roof-construction screws 6 in the screw magazine 5 lead into a single path 10. The path 10 is inclined and leads to an abutment means 21, which is mounted near a locking lever roller 11 and the pressure column 3. The combination of the abutment means 21, the locking lever roller 11 and the pressure column 3 acts as a screw separator/mounting device 43 for separating the screws 6 and mounting them into a guide sleeve 19 of a power screwdriver 20. The roof-construction screws 6 are continuously gravity fed to the screw separator/mounting device 43 by the inclined path 10.

Figure 6:
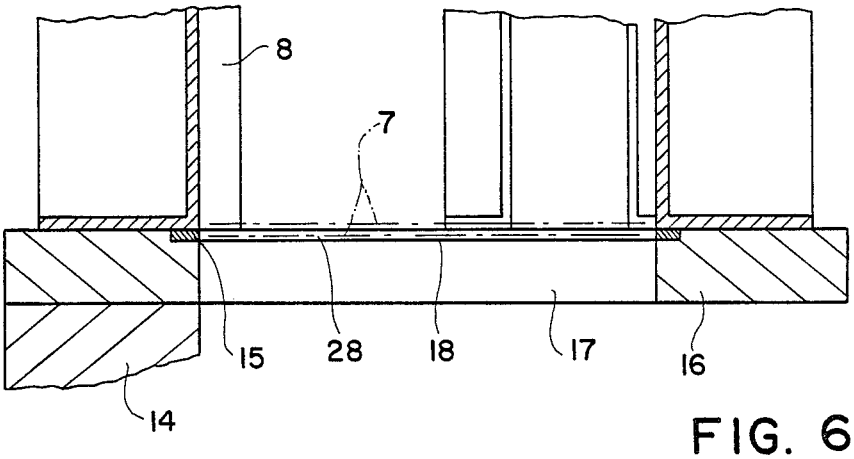
FIG. 6 is an elevational view partly in cross-section showing detail of a metal bracket separator portion of the apparatus of FIG. 1.
Figure 7:
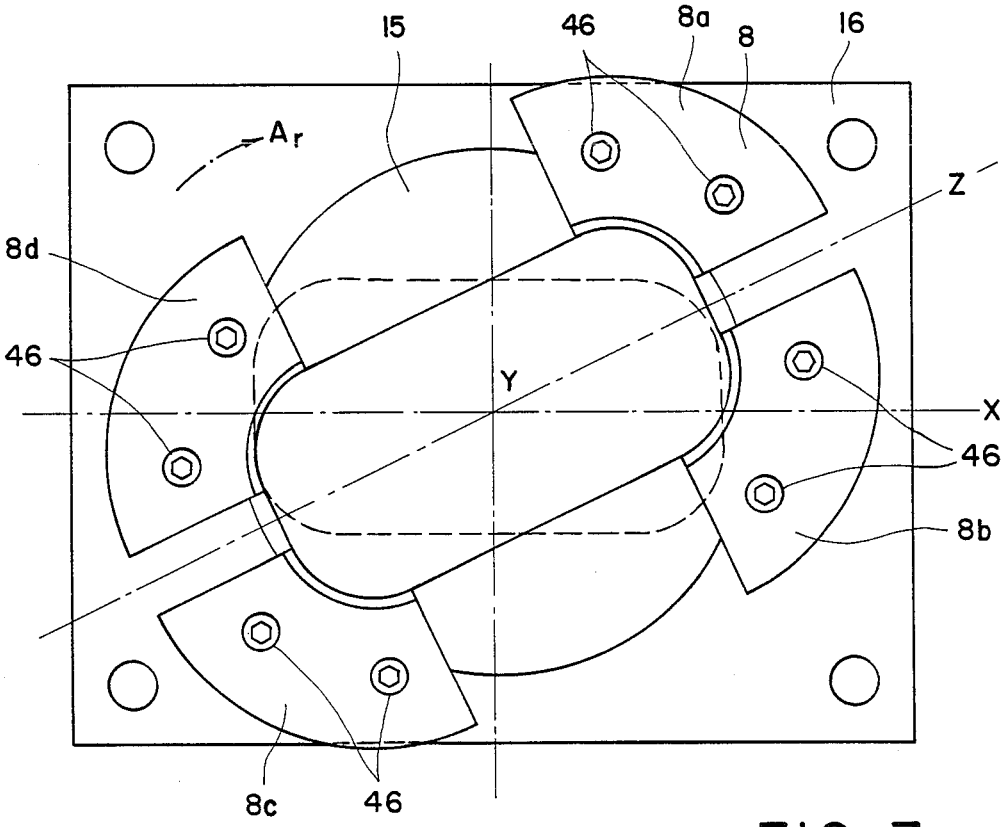
FIG. 7 is a partially cross-sectional top view of the metal bracket separator portion of the apparatus of FIG. 1.

A mounting bracket separator 15 comprises a pivoting locking plate, and is located in a groove 29 on a base plate 16 on the face of the frame 1 beneath the bracket magazine 8, as illustrated in FIGS. 6 and 7. In a rest or nonoperating position, a recess 18 in the separator 15 is situated obliquely to an end-to-end axis of the device 40. The recess 18 and the separator 15 both have approximately the same thickness as each bracket 7, the recess 18 having a length and a width slightly larger than those of each bracket 7.

The process of mounting roofing materials onto a roof will now be described. To begin the operation, the operator exerts pressure on a telescopic member 37 (FIG. 12) of the pressure column 3, which moves to a position A. The telescoping member 37 is operatively connected to a piston 12. The connection will be discussed below. Accordingly, the piston 12 moves to a corresponding position $A_p$. A lever 13 connects the piston 12 to a slide 14 of the bracket separation system. When the piston 12 is moved to position $A_p$, the lever 13 moves the slide 14 to position $A_S$ (indicated by the dot-dash line in FIG. 1). While being moved, the slide 14 drives a driving pin 32 (FIG. 10), which rotates the separator 15 to a position $A_R$ (FIG. 7), separating the bottom bracket 7 from the brackets 7 stored in the bracket magazine 8, and aligning the recess 18 in the separator 15 with a recess 17 in the base plate 16. The recess 17 has a length and width slightly larger than those of a bracket 7. When the separator 15 is in position $A_R$ (FIG. 7), the single separated metal bracket 7 is gravity fed through the recess 18 in the separator 15 and the recess 17 in the base plate 16 to a premounting position in the slide path of the slide 14. In this way, one bracket 7 at a time is fed by the separator 15 during each rotation. This will be further discussed below in reference to FIGS. 6 and 7.

Figures 12, 13, 14:
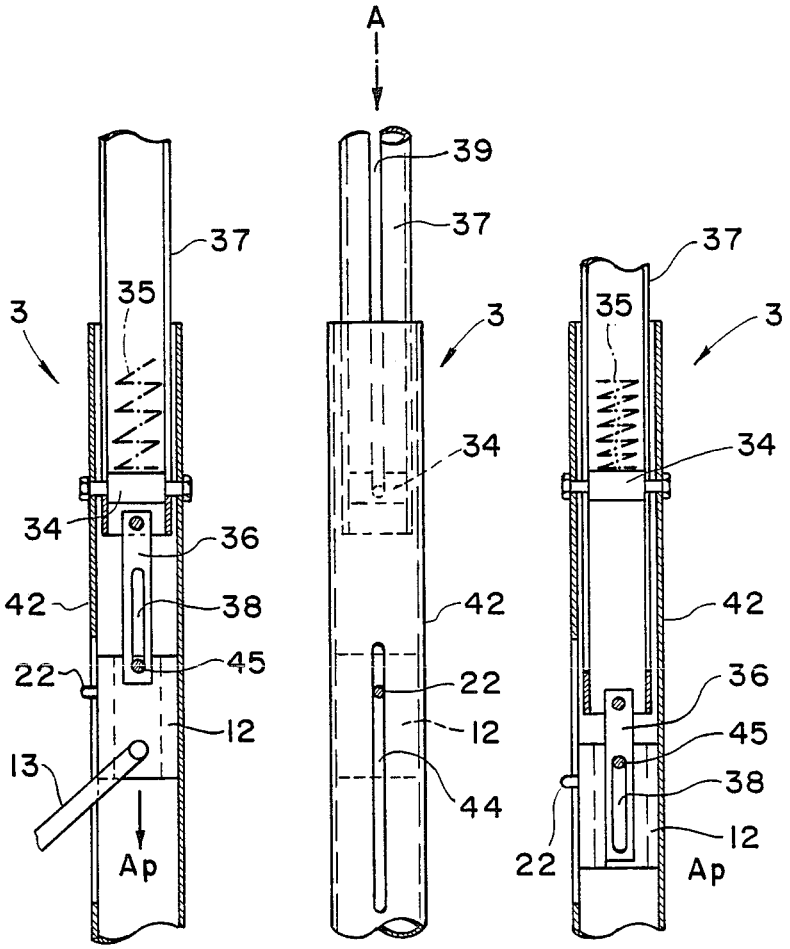
FIG. 12 is a schematic elevational cross-sectional view of the pressure column portion of the apparatus of FIG. 1 in a first working position.
FIG. 13 is a cross-sectional side view of the pressure column of FIG. 12.
FIG. 14 is a schematic elevational cross-sectional view of the pressure column portion of the apparatus of FIG. 1 in a second working position.

By the time the single, separated bracket 7 has dropped through the recesses 17 and 18, the slide 14 has completed its motion away from the pressure column 3 to position $A_S$. When pressure on the telescoping member 37 is removed, the telescoping member 37 moves to a position B by a spring force applied by a spring 35 (FIG. 12). The piston 12 moves correspondingly, which causes the lever 13 to again displace the slide 14. The slide 14 moves the separated bracket 7 into its mounting position. The bracket 7 will be applied to the roofing material from this position.

Figure 5:
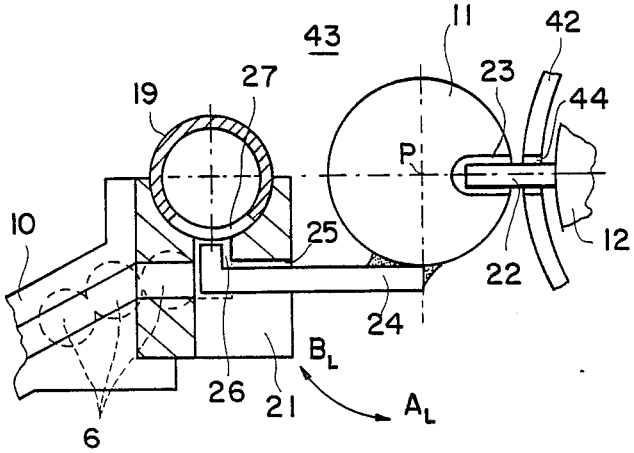
FIG. 5 is a partially cross-sectional top view showing detail of a portion of a screw feed attachment and separator of the apparatus of FIG. 1 and the guide sleeve and locking lever roller of FIG. 4.

Simultaneous with the moving of the telescoping member 37 to position A, the locking lever roller 11 swings to a position $A_L$, as illustrated in FIG. 5. This allows the screw 6 which had been abutting against locking levers 24 to be positioned in a notch 26 against the abutment means 21 for mounting into the guide sleeve 19 of the power screwdriver 20. When the spring force moves the telescoping member 37 to position B, the locking lever roller 11 is rotated in the opposite direction, causing the locker levers 24 to position the screw 6 into the guide sleeve 19 of the power screwdriver 20. This will be described in further detail below.

The basic operation of an initial working stroke of the fastening device 40 has been described above. All working strokes in a series of strokes follow the same basic procedure as described above for positioning the mounting bracket 7 and the screw 6. However, in the second and all subsequent strokes, the power screwdriver 20 screws a combination of a bracket 7 and a screw 6 into the ceiling structure below the roof while the positioning of a new combination of a screw 6 and a bracket 7 towards their respective mounting positions is taking place.

Figure 4:
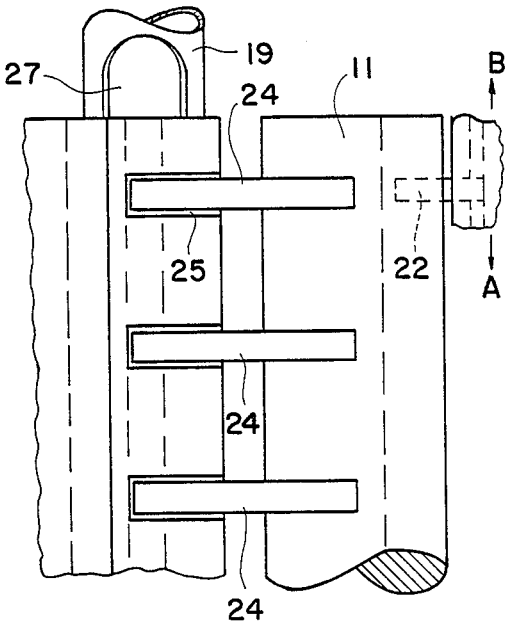
FIG. 4 is an elevational view partially in cross-section of a guide sleeve portion and the locking lever roller portion of the apparatus of FIG. 1.

Operation of the cam-controlled locking lever roller 11 will now be described with reference to FIGS. 3 through 5.

A nose gear 22 is mounted on the piston 12 for cooperating with a curved recess 23, which is provided longitudinally in the locking lever roller 11. The up and down motion of the piston 12 thereby causes the controlled back and forth rotation of the locking lever roller 11 described above.

Prior to the beginning of the first working stroke, that is, prior to the initial pressure being exerted on the telescoping member 37, the locking levers 24, which extend radially from the locking lever roller 11, extend into recesses 25 of the abutment means 21, at position $B_L$. This prevents any of the screws 6 from entering the guide sleeve 19 through an opening 27. When the telescoping member 37 moves to position A, the nose gear 22 runs down the curved recess 23 of the locking lever roller 11, thereby rotating the locking lever roller 11 to position $A_L$. This rotation moves the locking levers 24 out of the recesses 25 in the abutment means 21. Gravity forces a single screw 6 from the inclined path 10 into the notch 26 in the abutment means 21. Thus, when the telescoping member 37 moves to position B, the nose gear 22 moves back up the curved recess 23, causing the locking lever roller 11 and the locking levers 24 to move back to position $B_L$, their starting position. In moving back to this position, the locking levers 24 force the screw 6 in the notch 26 of the abutment means 21 through the opening 27 and into the guide sleeve 19. The position of the thus mounted screw 6 is above the single, separated bracket 7, which has been moved to its mounting position by the slide 14, as described above. Thus, the screw 6 and the bracket 7 are ready for mounting roofing materials onto the roof by means of the power screwdriver 20.

Details of the operation of the separator 15 will now be discussed below with reference to FIGS. 6 and 7.

The magazine 8 for storing the brackets 7 is situated on the frame 1 above and aligned with the separator 15, such that the brackets 7 in the magazine 8 are aligned with the recess 18 of the separator 15 when the telescoping member 37 is in its rest or initial position. That is, the magazine 8 is mounted on the frame 1 along an axis Z, which is oblique to an axis X of the frame 1. Since the recess 18 in the separator 15 has the same depth as the height of a single bracket 7, when the separator 15 is rotated about its center Y, the bottom bracket 7, which fits snugly in the recess 18 of the separator 15, is separated from the stored brackets 7 in the magazine 8. Thus, when the separator 15 rotates to position $A_R$, the recess 17 in the base plate 16 (the recess 17 having the approximate shape of the brackets 7), the recess 18 in the separator 15 and the single bracket 7 are all aligned one above the other. The remaining brackets 7 are retained in the magazine 8 obliquely to the position of the recesses 17 and 18 and the single, now separated bracket 7. The single, separated bracket 7 is gravity fed through the recess 17 in the base plate 16, to a position in the path of the slide 14, for moving to its mounting position by the slide 14.

Figure 8:
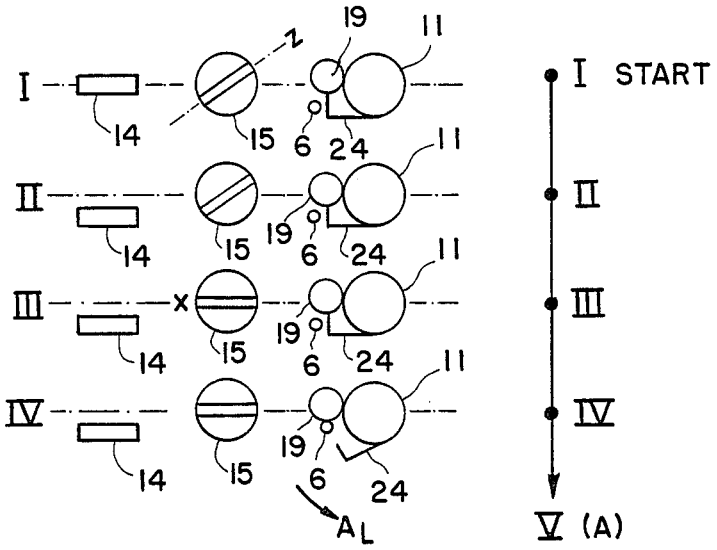
FIGS. 8 and 9 are schematic top views illustrating the respective working strokes of a metal bracket slide, the metal bracket separator and the locking lever roller portions of the apparatus of FIG. 1.

Referring now to FIG. 8, the positions of the slide 14, the separator 15 and the locking levers 24 at various stages of the downward movement of the telescoping member 37 are illustrated. Point I represents the initial starting position of the telescoping member 37, at which point downward movement of the telescoping member 37 has not been initiated. At point I, the slide 14, the separator 15, and the locking levers 24 are in their rest positions.

When the telescoping member 37 has moved down to point II, the slide 14 has been moved to the rear of the separator 15 with respect to the pressure column 3.

When the telescoping member 37 has reached point III in its downward movement, the separator 15 has been rotated together with the single bracket 7 (not shown in FIG. 8) so as to deposit the bracket 7 for movement by the slide 14 into its mounting position. The slide 14 and the locking levers 24 remain in their respective prior positions.

By the time the telescoping member 37 has reached point IV, the nose gear 22 has already cooperated with the curved recess 23 to rotate the locking lever roller 11, so as to allow the single screw 6 to come to rest at its premounting position. The slide 14 and the separator 15 maintain their respective positions from point III. This time delay will be explained in detail below.

Point V corresponds to the telescoping member 37 reaching position A, and the end of its downward motion.

Figure 9:
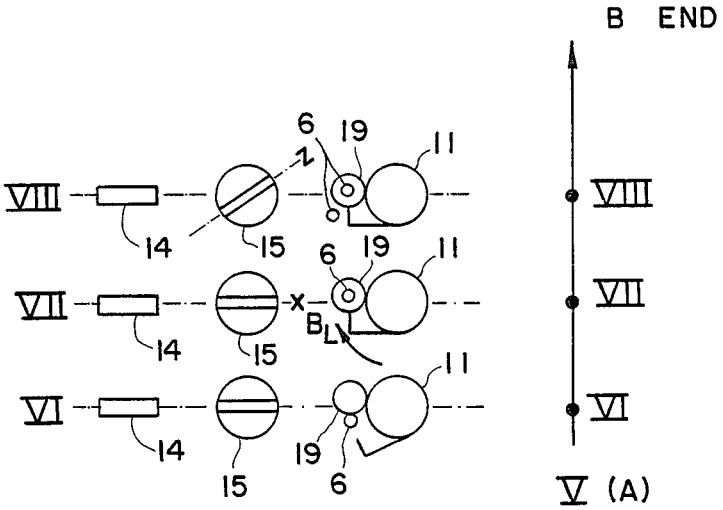

The corresponding relative movements of the slide 14, the separator 15 and the locking levers 24 when the telescoping member 37 is moving upward are illustrated in FIG. 9. Upon the telescoping member 37 reaching point VI, the slide 14 has returned nearly to its initial position, thereby depositing the single, separated bracket 7 in its mounting position. The separator 15 and the locking levers 24 maintain their relative positions.

By the time the telescoping member 37 has moved up to point VII, the nose gear 22 of the piston 12 has once again cooperated with the curved recess 23 of the locking lever roller 11, thereby rotating the locking lever roller 11 and moving the locker levers 24 such that the screw 6 is placed in its final mounting position in the sleeve 19.

At point VIII the telescoping member 37 has reached position B, which corresponds to its initial position. By this time, the slide 14 has now returned to its initial position, the separator 15 has rotated back to its oblique position and a new bracket 7 has been gravity fed into the recess 18 (FIG. 6), in preparation for the next working stroke. Similarly, a new screw 6 has been gravity fed from the inclined path 10 to abut against the now closed locking levers 24.

Beginning with the second downward stroke and recurring on each subsequent downward stroke of the telescoping member 37, the power screwdriver 20 inserts the single, separated screw 6 through the single, separated mounting bracket 7 and into the ceiling structure. The fastening device 40 thereby fastens any roofing materials positioned beneath fastening device 40 to the roof with the screw 6 and the bracket 7. The device 40 is moved, and the process is repeated until the roofing materials are completely fastened.

Figure 10:
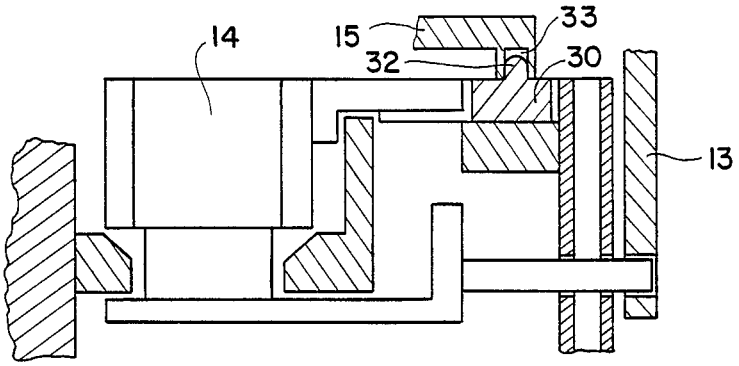
FIG. 10 is a cross-sectional end view of a slide control portion of the apparatus of FIG. 1.
Figure 11:
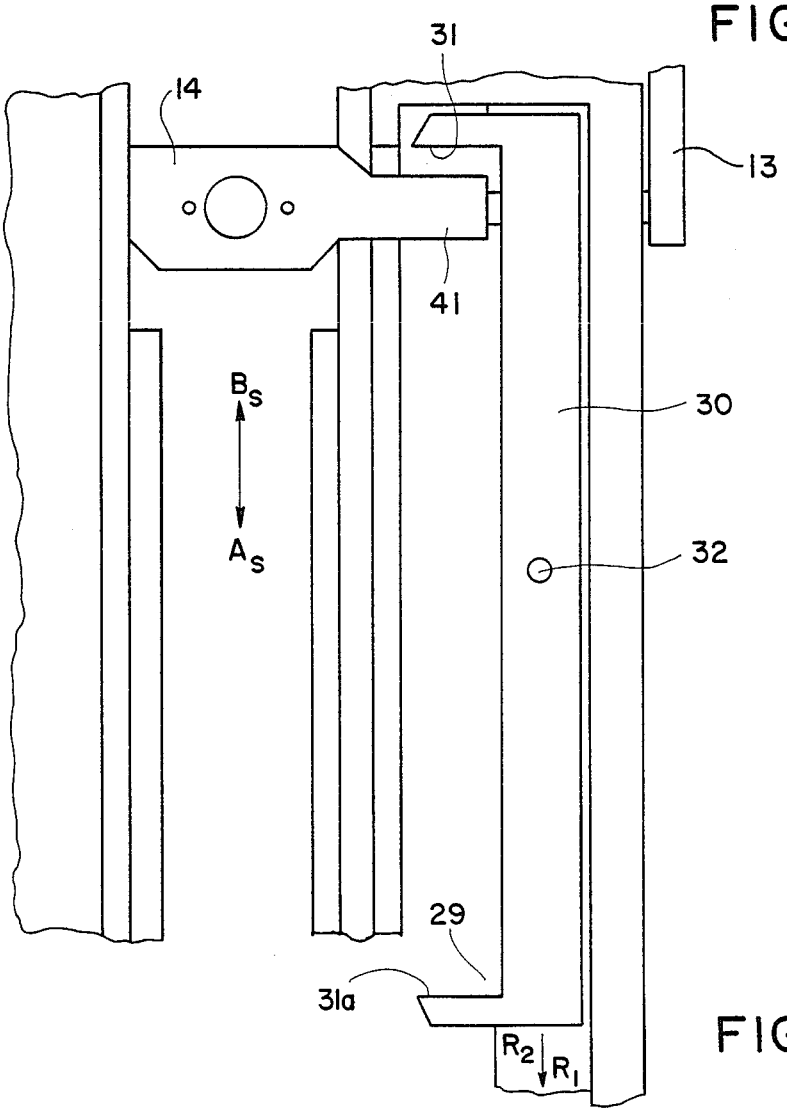
FIG. 11 is a schematic top view of the slide control portion of the present invention illustrated in FIG. 10.

The time delay of the slide 14 is illustrated in FIGS. 10 and 11. The slide 14 is moved by the lever 13. A portion 41 of the slide 14 is positioned within a recess 29 of a rail 30. This serves two purposes. First, the recess 29 limits the range of motion for the slide 14. Second, the rail 30 has two positions $R_1$ and $R_2$, and is moved from the position $R_1$ to position $R_2$ by the slide 14. When the lever 13 has moved the slide 14 in one direction or the other, the portion 41 of the slide 14 contacts one of the respective inside end surfaces 31, 31*a* of the rail 30, which will be in one of the two positions. The slide 14 keeps moving until the rail 30 has reached its second position. This causes the rail 30 to shift in one direction or the other from position $R_1$ to position $R_2$, or vice versa, depending on the direction in which the slide 14 is being moved by the lever 13. Mounted on the rail 30 is a nose gear 32, which cooperates with a recess 33 in the separator 15. The movement of the rail 30 near the end of the movement of the slide 14 causes the previously discussed rotation of the separator 15 by the interaction of the nose gear 32 and the recess 33. Thus, the relative time delay is obtained due to the movement of the slide 14 between the inner end surfaces 31, 31*a* of the rail 30.

The operation of the pressure column 3 with respect to the working stages is illustrated in FIGS. 12 and 14. FIG. 13 is a side view of the pressure column of FIGS. 12 and 14 in the position illustrated in FIG. 12. The two major portions of pressure column 3 are a hollow, lower fixed column 42 which is mounted on the frame 1, and the telescoping member 37, which extends from and is slidably mounted in the upper portion of the fixed column 42. The piston 12, to which is attached the lever 13 and which rotates the locking lever roller 11, is slidably mounted within the fixed column 42 beneath the telescoping member 37. A spring abutment means 34 is fixedly mounted within the fixed column 42 above the piston 12, and the telescoping member 37 is slidably mounted about the spring abutment means 34 along longitudinal recesses 39. The telescoping member 37 is connected to the piston 12 by means of a dynamic distance piece 36. The dynamic distance piece 36 is fixedly attached to the bottom portion of the telescoping member 37, but is slidably attached to the piston 12 by means of a longitudinal opening 38 in the dynamic distance piece 36. A knob 45 mounted on the piston 12 traverses the length of the opening 38 before the piston 12 will move. This creates a time delay between the time the telescoping member 37 is depressed downward into the fixed column 42 and the piston 12 starts moving downward for beginning the movement of the slide 14 via the lever 13. For the same reason, a delay also occurs when the downward pressure on the telescoping member 37 ceases, and the telescoping member 37 is forced upward by the spring 35.

At the beginning of a working stroke, the telescoping member 37 is at rest in an up position, as illustrated in FIG. 12. In FIG. 12, the spring 35 is not compressed, and the piston 12 is also in its up condition. In FIG. 14, the telescoping member 37 has been depressed into the fixed column 42. During the downward motion of the telescoping member 37, but after the delay created by the opening 38 in the dynamic distance piece 36, the piston 12 is also moved to its down position. This of course results in the movement of the slide 14 to an opposite side of the recess 17 to await the deposit on the slide path of a single, separated bracket 7. At the same time, the nose gear 22, which extends through a longitudinal recess 44 in the fixed column 42, has caused the locking lever roller 11 to rotate, thereby allowing a single screw 6 to be gravity fed into the notch 26 for mounting into the guide sleeve 19. Also, the spring 35 is under pressure in FIG. 14.

When the downward pressure on the telescoping member 37 ceases, the spring 35 forces telescoping member 37 upward, thereby pulling the piston 12 upward (after the time delay) and rotating the locking lever roller 11 and the locking levers 24. This mounts the screw 6 in the notch 26 into the guide sleeve 19 of the power screwdriver 20. Simultaneously, the lever 13 pulls the slide 14 and the single, separated bracket 7 back, placing the single, separated bracket 7 into position underneath the mounted screw 6. During the next working stroke, the power screwdriver 20 will screw the screw 6 through the bracket 7 and any roofing materials and into the ceiling structure, thereby mounting the roofing materials on the roof.

Many features and advantages of the present invention are apparent from the detailed specification, and thus it is intended by the appended claims to cover all such features and advantages of the device and method that would fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. An apparatus for the machine fastening of roofing materials to a roof, comprising:

a mobile frame having wheels;

a bracket magazine, mounted on said frame, for storing mounting brackets;

a roofing screw magazine, mounted on said frame, for storing roofing screws;

a bracket separator situated in said frame beneath said bracket magazine for separating a single bracket from the brackets stored in said bracket magazine;

a screw separator for separating a single screw from the screws stored in said screw magazine and placing the single, separated screw into a screw mounting position;

a depressible pressure column, having a moveable piston therein mounted on said frame;

a slide, moveable along a slide path, operatively connected to said piston and said bracket separator for moving the single, separated bracket into a bracket mounting position; and a power screwdriver for screwing the mounted screw through the mounted bracket and the roofing materials and into the roof for fastening the roofing materials to the roof.

2. An apparatus for the machine fastening of roofing materials to a roof according to claim 1, wherein said bracket magazine includes four corner members mounted on said frame so that the brackets stored therein are oblique to an end-to-end axis of said frame.

3. An apparatus for the machine fastening of roofing materials to a roof according to claim 1, wherein said roofing screw magazine includes a plurality of screw paths which lead into a single screw path, said single screw path being inclined and leading to said screw separator.

4. An apparatus for the machine fastening of roofing materials to a roof according to claim 1, wherein the brackets comprise metal brackets.

5. An apparatus for the machine fastening of roofing materials to a roof according to claim 1, wherein said screw separator includes a cam-controlled locking lever roller having locking levers.

6. An apparatus for the machine fastening of roofing materials to a roof according to claim 1, wherein said depressible pressure column includes a hollow fixed column mounted on said frame, a spring abutment member fixedly mounted in an upper portion of said fixed column, a telescoping member slidably mounted on said spring abutment member in said fixed column and being operatively connected to said piston, said telescoping member protruding from the upper portion of said fixed column, and said piston being slidably mounted in said fixed column beneath said spring abutment member, and spring means, mounted between said spring abutment member and said telescoping member, for applying force against said telescoping member, and wherein said apparatus further comprises lever means for connecting said piston to said movable slide, so that when said telescoping member is depressed and said piston correspondingly moves downward, said lever means moves said slide from a first slide position to a second slide position, and when said telescoping member is released and the spring force moves said telescoping member upward, moving said piston upward, said lever means pulls said slide back to the first position, said slide positioning the separated single bracket into the bracket mounting position.

7. An apparatus for the machine fastening of roofing materials to a roof according to claim 6, wherein said roofing screw magazine includes a plurality of screw paths which lead into a single screw path, said single screw path being inclined and leading to said screw separator.

8. An apparatus for the machine fastening of roofing materials to a roof according to claim 7, wherein said screw separator includes a cam-controlled locking lever roller having locking levers.

9. An apparatus for the machine fastening of roofing materials to a roof according to claim 8, wherein said locking lever roller is mounted next to said pressure column and includes a curved recess, and wherein said piston includes a first nose gear mounted thereon for cooperating with the curved recess in said locking lever roller, so that the downward motion of the piston rotates said locking lever roller and the locking levers in a first direction to permit the separated single screw to move to a premounting position, and the upward motion of the piston rotates said locking lever roller and the locking levers in an opposite direction to force the separated single screw into the screw mounting position.

10. An apparatus for the machine fastening of roofing materials to a roof according to claim 9, wherein said bracket magazine extends vertically from said frame and stores the brackets to an oblique angle from an end-to-end axis of said frame, and said bracket separator has a pivoting locking plate seated on said frame with an inner recess having slightly larger dimensions than one of said brackets, for pivoting and providing the separated single bracket from the bottom of the brackets stored in said vertical bracket magazine, and wherein said apparatus further comprises a second recess vertically extending beneath said bracket separator to a bracket premounting position in the slide path, so that when said pivoting locking plate pivots, the bottom bracket is separated from the brackets in said bracket magazine, and the separated single bracket is pivoted to be gravity fed through said second recess into the bracket premounting position.

11. An apparatus for the machine fastening of roofing materials to a roof according to claim 10, wherein the roofing screws are gravity fed from aid roofing screw magazine to the screw premounting position.

12. An apparatus for the machine fastening of roofing materials to a roof according to claim 10, further comprising a moveable rail having a second nose gear mounted thereon and first and second ends for cooperating with said slide, wherein said slide moves in the slide path along said rail freely to either of said ends of said rail, at which point the respective end cooperates with said slide to move said rail causing said second nose to gear to cooperate with said bracket separator to rotate said pivoting locking plate.

13. An apparatus for the machine fastening of roofing materials to a roof according to claim 9, wherein said pressure column further includes a dynamic distance piece for connecting said piston to said telescoping member, said dynamic distance piece having a longitudinal opening therein to provide a sliding connection with said piston for delaying motion of said piston relative to motion of said telescoping member.

14. An apparatus for the machine fastening of roofing materials to a roof according to claim 13, wherein the brackets comprise metal brackets.

15. A apparatus for the machine fastening of roofing materials to a roof according to claim 1, wherein in a first working stroke of said piston, the separated single bracket is separated from the brackets stored in said bracket magazine and fed to a bracket premounting position on the slide path, and the separated single screw is fed to a screw premounting position, and in a second working stroke of said piston the separated single bracket is moved to the bracket mounting position and the separated single screw is positioned to the screw mounting position.

16. An apparatus for the machine fastening of roofing materials to a roof according to claim 15, wherein during non-initial first working strokes of said piston, said power screwdriver screws the positioned screw through the mounted bracket and the roofing materials and into the roof.

17. An apparatus for the machine fastening of roofing materials to a roof according to claim 1 wherein said roofing screw magazine stores the roofing separately.

* * * * *